US006913504B2

(12) United States Patent
Zaslavsky et al.

(10) Patent No.: US 6,913,504 B2
(45) Date of Patent: Jul. 5, 2005

(54) METHOD FOR INTRODUCING MERCURY INTO A FLUORESCENT LAMP DURING MANUFACTURE AND A MERCURY CARRIER BODY FACILITATING SUCH METHOD

(75) Inventors: Gregory Zaslavsky, Marblehead, MA (US); Richard Speer, Concord, MA (US); Philip E. Moskowitz, Georgetown, MA (US); Joseph V. Lima, Salem, MA (US); Louise D. Cleary, Salem, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/603,354

(22) Filed: Jun. 25, 2003

(65) Prior Publication Data

US 2004/0043690 A1 Mar. 4, 2004

Related U.S. Application Data

(63) Continuation-in-part of application No. 10/308,943, filed on Dec. 3, 2002, and a continuation-in-part of application No. 10/230,621, filed on Aug. 29, 2002, now Pat. No. 6,784,609.

(51) Int. Cl.[7] ..... H01J 9/38

(52) U.S. Cl. ..... 445/53; 445/9; 445/42; 445/43; 445/56; 445/58; 313/550; 313/565

(58) Field of Search ..... 313/550, 565, 313/552, 564, 566, 490, 571, 639; 445/9, 38, 42, 43, 53, 56, 58

(56) References Cited

U.S. PATENT DOCUMENTS

| | | | | |
|---|---|---|---|---|
| 4,035,682 A | | 7/1977 | Bubar | 313/174 |
| 4,090,050 A | * | 5/1978 | Siiberg | 200/84 C |
| 4,393,325 A | | 7/1983 | van der Kooi | 313/552 |
| 4,528,209 A | | 7/1985 | Anderson et al. | 427/67 |
| 4,972,118 A | * | 11/1990 | Yorifuji et al. | 313/565 |
| 5,434,482 A | | 7/1995 | Borowiec et al. | 315/248 |
| 5,629,584 A | | 5/1997 | Borowiec et al. | 313/565 |
| 5,757,129 A | * | 5/1998 | Schafnitzel et al. | 445/9 |
| 5,767,617 A | | 6/1998 | Wharmby et al. | 313/489 |
| 5,994,837 A | | 11/1999 | Willems et al. | 313/550 |
| 6,097,137 A | | 8/2000 | Forsdyke et al. | 313/161 |

* cited by examiner

*Primary Examiner*—Joseph Williams
*Assistant Examiner*—Sharlene Leurig
(74) *Attorney, Agent, or Firm*—Carlo S. Bessone

(57) ABSTRACT

Method for introducing a limited amount of mercury into a fluorescent lamp during manufacture thereof includes the steps of forming the lamp with an exhaust tubulation therein open at an end thereof, exhausting the interior of the lamp through the exhaust tubulation, placing a body of metal material not reactive with mercury in the exhaust tubulation open end, the body having a coating of metal which amalgams with mercury, over a selected surface area of the body, and having mercury on the coated area of the body, such that a limited amount of the mercury is retained by the metal coating, and sealing the open end of the exhaust tubulation, whereby the amount of mercury retained on the body and introduced into the lamp is limited by the surface area of the metal coating on the body.

30 Claims, 4 Drawing Sheets

METHOD FOR INTRODUCING MERCURY INTO A FLUORESCENT LAMP DURING MANUFACTURE AND A MERCURY CARRIER BODY FACILITATING SUCH METHOD

CROSS-REFERENCE TO RELATED APPLICATIONS

This is a continuation-in-part of application Ser. No. 10/308,943, filed Dec. 3, 2002, in the name of Richard S. Speer et al, and a continuation-in-part of application Ser. No. 10/230,621, filed Aug. 29, 2002, now U.S. Pat. No. 6,784,609 in the name of Richard S. Speer et al.

BACKGROUND OF THE INVENTION

1. Field of the Invention

This invention relates to the manufacture of fluorescent lamps and is directed more particularly to the introduction of a limited amount of mercury into the lamp by way of a lamp exhaust tubulation. The invention further relates to a carrier body for placement in the lamp and which carries thereon a selected amount of mercury to be admitted to the lamp.

2. Description of the Prior Art

Fluorescent lamps typically include at least one tubulation which provides a conduit extending into the interior of the lamp envelope and which, in construction of the lamp, is used as an exhaust tubulation. At completion of manufacture, the exhaust tubulation is hermetically closed.

Before sealing off of the exhaust tubulation open end, a measured amount of mercury is introduced into the lamp. One of the challenges facing lamp manufacturers is to minimize the amount of mercury put into the lamp. It has been found difficult to regulate the introduction of small amounts, such as nine milligrams or less, of mercury.

There is thus a need for a method for introducing small amounts of mercury into a fluorescent lamp. There is further a need for a device which is structured to facilitate the introduction of limited amounts of mercury and which is easily handled in lamp manufacturing procedures.

SUMMARY OF THE INVENTION

An object of the invention is, therefore, to provide a method for introducing a limited amount of mercury into an envelope of a fluorescent lamp during manufacture of the lamp.

A further object of the invention is to provide a body for placement in the lamp during manufacture, which body is adapted to receive and retain only a selected amount of mercury and serve as a carrier for the mercury introduced into the lamp.

With the above and other objects in view, a feature of the present invention is the provision of a method for introducing a limited amount of mercury into an envelope of a fluorescent lamp during manufacture of the lamp. The method includes the steps of forming the fluorescent lamp with an exhaust tubulation therein, the exhaust tubulation being open at an end thereof, exhausting the interior of the lamp envelope through the exhaust tubulation open end, and placing a body of a metal material which does not interact with mercury, in the lamp by way of the exhaust tubulation open end. The body is provided with a coating of a metal which amalgams with mercury, over a selected surface area of the body, and is provided with mercury on the coated area of the body, such that a limited and selected amount of the mercury is retained on the body by the coating metal, and sealing the open end of the exhaust tube. The amount of mercury retained on the body is limited by the selected surface area of the coating on the body.

In accordance with a further feature of the invention, there is provided a further method for introducing a limited amount of mercury into an envelope of a fluorescent lamp during manufacture of the lamp. The method includes the steps of forming the fluorescent lamp with an exhaust tubulation therein, the exhaust tubulation being open at an end thereof and being provided with a body retention structure proximate the open end, exhausting the interior of the lamp envelope through the exhaust tubulation open end, and placing a body of metal material not reactive with mercury in the exhaust tubulation between the retention structure and the exhaust tubulation open end. The body is provided with a coating of a metal which amalgams with mercury, over a selected surface area of the body, and is provided with mercury on the coated area of the body, such that a limited and selected amount of the mercury is retained on the body by the coating metal. The method further comprises sealing the open end of the exhaust tubulation. The amount of mercury retained on the body is limited by the surface area of the coating on the body.

In accordance with a still further feature of the invention, there is provided a method for introducing a limited amount of mercury into a fluorescent lamp during manufacture of the lamp. The method comprises the steps of forming the lamp with an exhaust tubulation therein, the exhaust tubulation being open at an end thereof, and exhausting the interior of the lamp through the exhaust tubulation open end. The method further includes providing a body of metal material not reactive with mercury, the body being sized to enter the exhaust tubulation, electroplating a coating of metal which amalgams with mercury over a selected surface area of the body, and placing mercury on the coated area of the body, such that a limited amount of mercury is retained on the body by the metal coating, placing the body in the lamp by way of the exhaust tubulation, and sealing the open end of the exhaust tubulation.

In accordance with a still further feature of the invention, there is provided a mercury carrier body for placement in a fluorescent lamp during manufacture of the lamp. The carrier comprises a body comprising a selected one of (i) a sphere and (ii) a segment of wire, of a metal which does not interact with mercury, a coating of a metal which amalgams with mercury, disposed over a selected surface area of the body, and mercury disposed on the metal coating and retained thereby in an amount up to that permitted by the selected surface area of the metal coating. The body thus carries into the lamp a selected amount of mercury and is adapted for retention in the lamp after sealing of the lamp at completion of manufacture.

The above and other features of the invention, including various novel details of construction and combinations of parts and method steps, will now be more particularly described with reference to the accompanying drawings and pointed out in the claims. It will be understood that the particular methods and devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
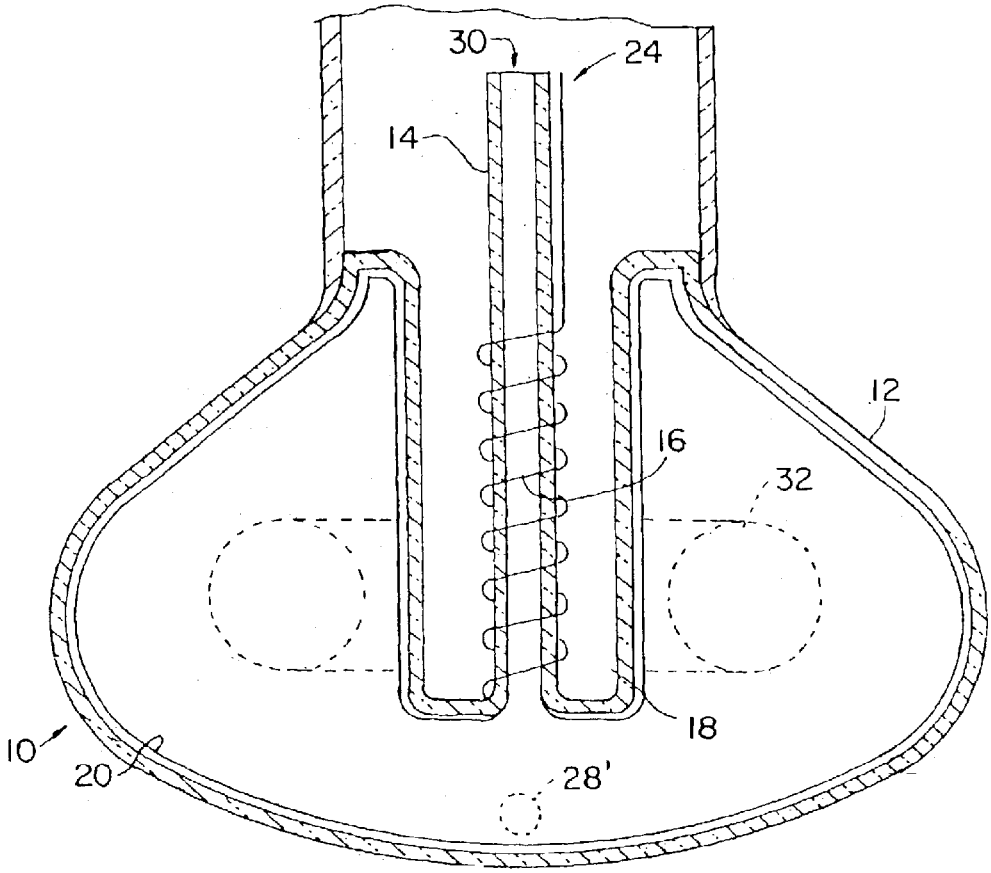
FIG. 1 is a diagrammatic sectional view of one type of fluorescent lamp during manufacture thereof, and illustrative of embodiments of the invention.

Referring to FIG. 1, it will be seen that a known compact fluorescent lamp 10 is provided with a light-transmissive envelope 12 containing an ionizable gaseous fill for sustaining an arc discharge. In manufacture, the lamp 10 is dosed with the fill via an exhaust tubulation 14 in a known manner. A suitable fill, for example, comprises a mixture of a rare gas (e.g., krypton and/or argon) and mercury vapor. An excitation coil 16 is disposed within, and removable from, a re-entrant cavity 18 within the envelope 12. For purposes of illustration, the coil 16 is shown schematically as being wound about the exhaust tubulation 14. However, the coil 16 may be spaced apart from the exhaust tubulation 14 and wound about a core of insulating material (not shown), or may be free standing (not shown), as desired. The interior surfaces of the envelope 12 are coated in well-known manner with a suitable phosphor 20. In the type of lamp illustrated in FIG. 1, the envelope 12 fits into one end of a base assembly (not shown) containing a radio frequency power supply with a standard Edison type lamp base.

Figure 2:
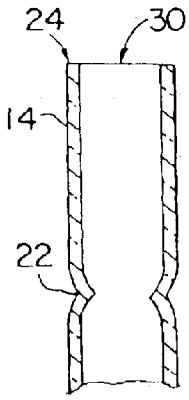
FIG. 2 is a sectional view of an exhaust tubulation portion of the lamp of FIG. 1, the tubulation portion being shown with a pinched portion for retention of a spherical body.
Figure 3:
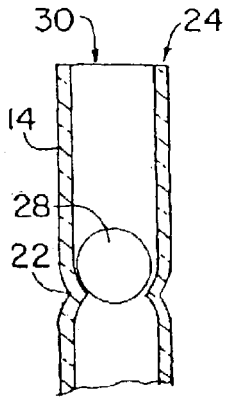
FIG. 3 is similar to FIG. 2, but further includes a mercury carrier in the form of a spherical body resting on the pinched portion.

An indentation, or pinched portion 22 (FIG. 2), is disposed proximate, a tip-off region 24 of the exhaust tubulation 14. The tip-off region 24 is the area at the free end of the exhaust tubulation 14 which is sealed, or "tipped off" to form the closed end 26 (FIG. 4) of the exhaust tubulation after evacuating the lamp therethrough.

After the lamp is evacuated through the exhaust tubulation 14, an appropriately sized and shaped metal ball 28, preferably of steel or steel alloy, is inserted into the exhaust tubulation 14 through an opening 30 at the tip-off region 24. By virtue of the presence of the pinched portion 22 and the size and shape of the ball 28, the ball remains on the side of the pinched portion 22 away from the re-entrant cavity 18'. Finally, as noted above, the exhaust tubulation 14 is tipped-off at a location proximate the ball 28 to form the tubulation closed end 26.

In operation, current flows in the coil 16 as a result of excitation by the aforementioned radio frequency power supply. A radio frequency magnetic field is thereby established within the envelope 12 which ionizes and excites the gaseous fill contained therein, resulting in a toroidal discharge 32 (FIG. 1) and emitting ultraviolet radiation therefrom. The phosphor 20 absorbs the ultraviolet radiation and emits visible radiation.

Figure 4:
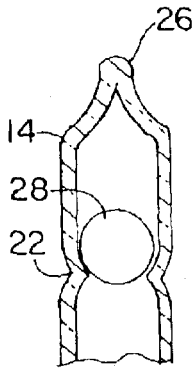
FIG. 4 is similar to FIG. 3, but shows an end of the tubulation closed off.

Referring to FIG. 4, it will be seen that in accordance with the present invention there is provided the ball 28 disposed in the glass tubulation 14 and retained by the pinched portion 22 of the tubulation. In accordance with the invention, the ball 28 serves as a mercury carrier.

Figure 5:
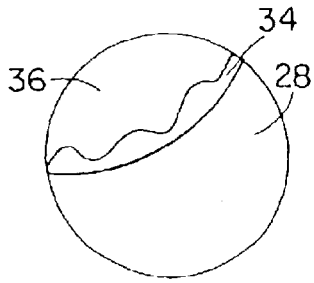
FIG. 5 is an enlarged side elevational view of an embodiment of mercury carrier in the form of a sphere illustrative of an embodiment of the invention.

Referring to FIG. 5, it will be seen that the ball 28 comprises a sphere of metal, preferably steel or steel alloy. A coating 34 of a metal is disposed on the ball 28. The coating metal is a metal which amalgams with mercury, such as silver, gold, indium, copper, and tin, and alloys thereof. The surface area of the coating metal determines the amount of mercury which will be retained thereby. The surface area may comprise the whole of the surface area of the ball, or any portion less than the whole of the surface of the ball, the latter being illustrated in FIG. 5. If the selected surface area is less than the whole, it is preferable that the coating be disposed in a single patch on the surface of the ball.

Mercury 36 is applied to the metal coating 34. The metal coating 34, by virtue of the selected surface area thereof, is operative to retain a predetermined amount of the mercury. In practice, amounts of mercury up to nine milligrams are readily obtainable on a steel ball plated with silver, indium or gold and having a diameter of three millimeters. As the diameter, and thus the surface area of the ball, decreases the weight of the mercury that can be carried is similarly reduced. A dose of about 3–5 milligrams is commonly selected and easily supported by the metal coating. The ball 28, with the coating 34 and mercury 36 thereon, is placed in the exhaust tubulation 14 and the open end 30 of the tubulation is sealed, as at 26 (FIG. 4).

The ball 28 thus serves to accurately limit dosing of the lamp with very small amounts of mercury, from about 9 milligrams to well under 1 milligram. Further, as an additional benefit, the coating 34 prevents the liquid mercury from depositing or collecting in the lamp.

The ball 28 may be used in conjunction with one or more of the usual glass balls for supporting an amalgam and/or for spacing the ball 28 and/or amalgam balls in the exhaust tubulation.

The ball 28 need not necessarily be disposed in the exhaust tubulation 14. Rather, the ball 28 may be fed into the lamp envelope 12 through the exhaust tubulation 14. In this embodiment, the tubulation is not provided with the pinched portion 22 prior to introduction of the ball, and the ball 28 enters the envelope and resides therein, as at 28' in FIGS. 1 and 9. The open end of the exhaust tubulation is thereafter pinched, if amalgam balls are to be used, and thereafter closed.

Steel balls are well suited to serve as mercury carriers. Steel does not interact with mercury, is inexpensive and is readily available. In addition, the magnetic characteristic of steel is an advantage in processing the balls during manufacture. While steel is preferred, other metals which do not interact with mercury are acceptable, such as nickel and various ferrous alloys.

Figure 6:
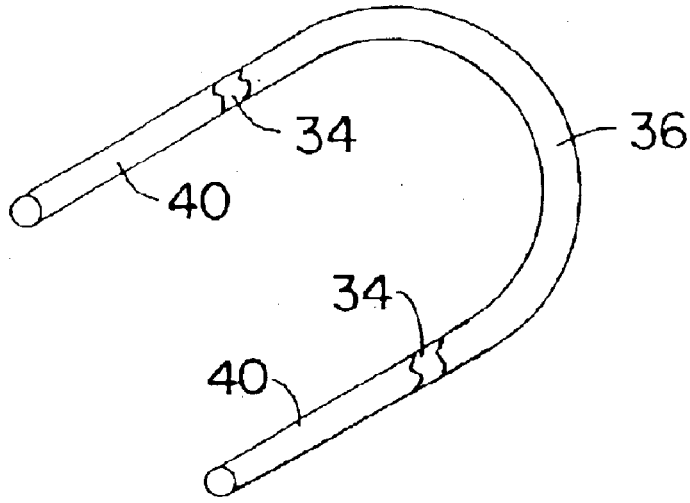
FIG. 6 is a perspective view of an alternative embodiment of mercury carrier in the form of a segment of wire.

Referring to FIG. 6, it will be seen that in an alternative embodiment the mercury carrier may be in the form of a metal wire 40, preferably of steel or steel alloy, but acceptably of any metal not reactive with mercury. The coating 34 of a metal which amalgams with mercury is disposed on the wire 40. As noted above with respect to the metal ball carrier, the surface area of the coating 34 determines the amount of mercury which will be retained thereby, and the coating may be applied to a selected area of the wire.

Mercury 36 is applied to the metal coating 34. Amounts of mercury up to nine milligrams are readily disposed on the wire.

Figure 7:
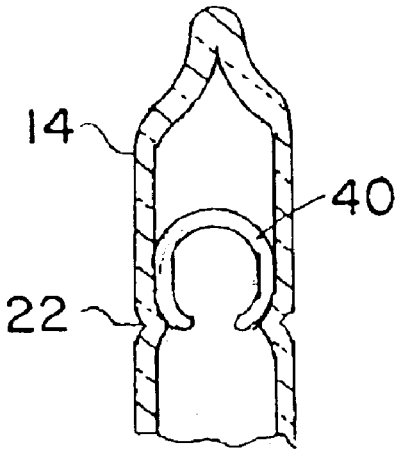
FIGS. 7 and 8 are similar to FIG. 4, but showing the mercury carrier of FIG. 6 disposed in the lamp tubulation portion.
Figure 8:
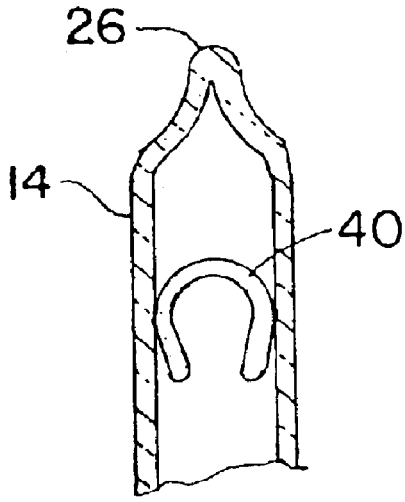

As shown in FIG. 7, the wire 40 may be placed in the lamp exhaust tubulation 14 at the pinched portion 22 and retained thereby. Alternatively, when using the wire 40 in a u-shaped configuration, shown in FIG. 6, the springiness of the wire retains the wire in the tubulation 14 without the need of a pinched portion.

Figure 9:
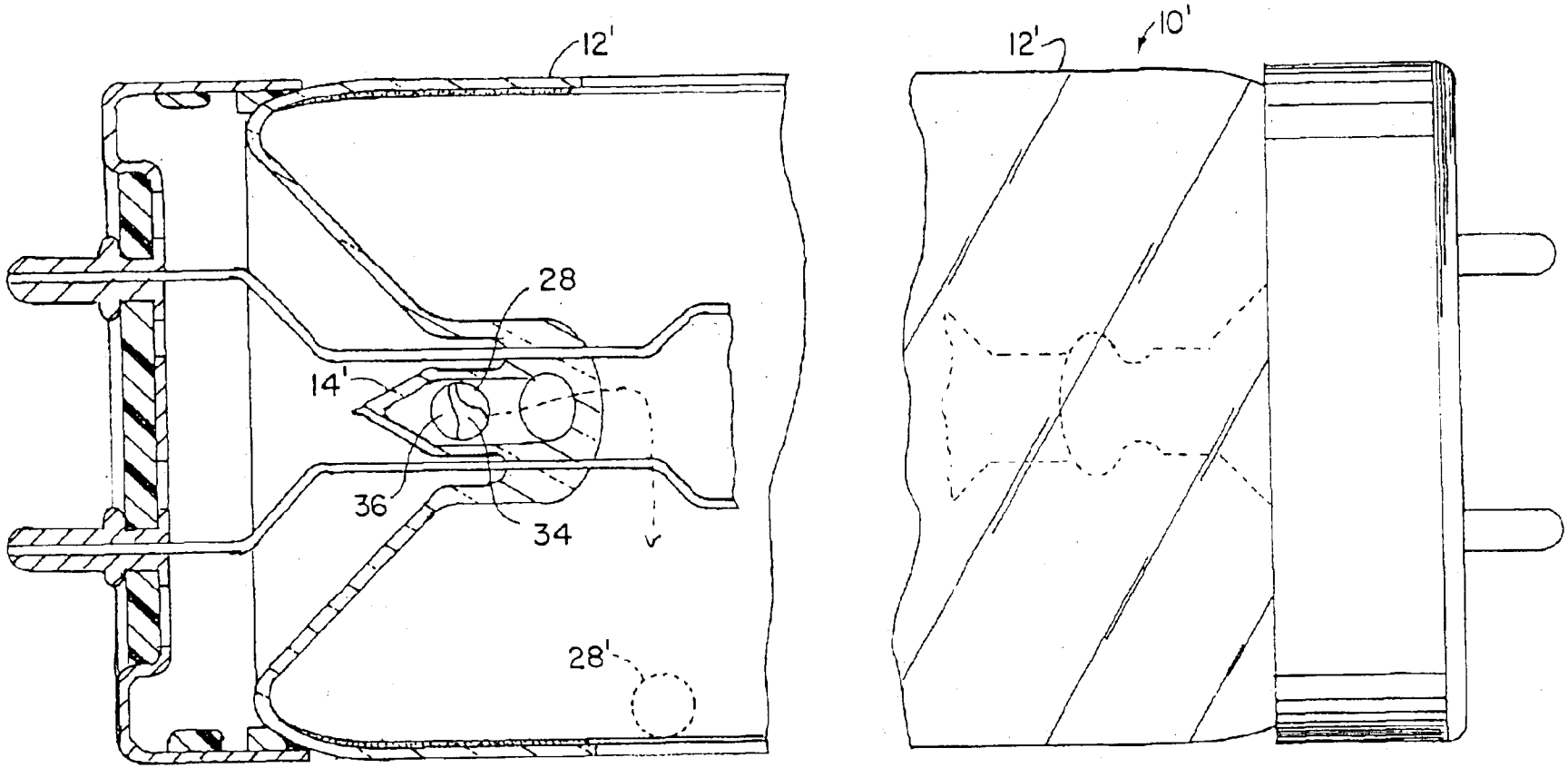
FIG. 9 is a diagrammatic view showing another type of fluorescent lamp.

As in the case of the metal ball, the wire 40 may be configured to simply pass through the tubulation 14 and enter the lamp envelope 12 to occupy the position 28' shown in FIGS. 1 and 9.

In either embodiment, the metal carrier body 28, 40 accepts electroplating of the coating 34, which facilitates the application of very thin layers (0.0001–0.0015 inch) of the coating material.

Referring to FIG. 9, it will be seen that a further well-known fluorescent lamp 10' is provided with an elongated tubular light-transmissive envelope 12' containing ionizable gaseous fill for sustaining an arc discharge. As in the case in the embodiment of FIG. 1, in manufacturing the linear lamp 10' is dosed with fill via an exhaust tubulation 14' in a known manner.

In accordance with the invention, after the lamp is evacuated through the exhaust tubulation 14', the above-described ball 28 is inserted into the lamp by way of the exhaust tubulation. Thereafter, the exhaust tubulation is closed. Thus, the ball 28, with the aforesaid coating 34 and mercury 36, is enclosed in the envelope 12' of the lamp 10' and functions as a mercury carrier, the same as in the lamp of FIGS. 1 and 9. In the linear lamp 10' the exhaust tubulation 14' typically is not provided with a pinched portion. Accordingly, the ball 28 passes through the tubulation 14' and resides in the envelope 12', as at 28' in FIG. 9, without constraint other than the confines of the envelope.

There are thus provided methods for introducing a selected and limited amount of mercury into an envelope of a fluorescent lamp during manufacture of the lamp. There are further provided mercury carrier bodies in the forms of a ball and a segment of wire for placement in the lamp during manufacture, and which are adapted to retain the selected amount of mercury for dosing the lamp.

Fluorescent lamps of both types mentioned hereinabove typically contain a quantity of an amalgam, commonly located in the exhaust tubulation and operative to reduce mercury vapor pressure to permit optimum light output at elevated temperatures. Such amalgams also provide a broadened peak in a light output versus temperature curve, so that near optimum light output is obtained over an extended range of temperatures.

The amalgams in use constitute alloys capable of absorbing mercury from a gaseous phase. The alloys amalgamate with excess mercury to regulate the mercury vapor pressure within the lamp.

When an amalgam fluorescent lamp is turned off, the amalgam cools and the mercury vapor within the lamp is, gradually absorbed into the amalgam. When the lamp is turned on, the lumen output is significantly reduced until the amalgam is warmed up to a point at which the amalgam emits sufficient mercury vapor to permit efficient lamp operation.

In some types of lamps, particularly electrodeless fluorescent lamps, it is important that the amalgam be prevented from settling within the arc environment in the lamp envelope where the amalgam can cause deleterious changes in the lumen output and the lumen-temperature performance of the lamp.

In base-up lamps (FIG. 1) there has been a particular problem in that, in use, the sealed end of the tubulation is pointed upwardly and the end of the tubulation that opens into the lamp envelope is disposed downwardly of the amalgam. The amalgam has tended to drop by gravity downwardly into the lamp envelope, where a much higher temperature is present, causing a sudden rise in mercury vapor pressure and an increase in lamp voltage, resulting in the occurrence of black spots on the glass envelope. If the lamp voltage exceeds the maximum sustaining voltage of the ballast provided in the lamp, the lamp extinguishes. There is thus required means for retaining liquid amalgam in the tubulation, but permitting mercury vapor to exit the tubulation and flow into the lamp envelope.

Figure 10:
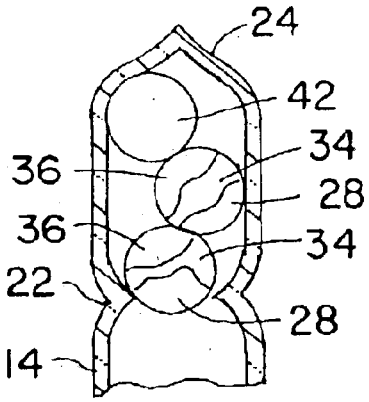
FIG. 10 is similar to FIG. 3, but further including an amalgam carrying body in the tubulation portion.

Referring to FIG. 10, it will be seen that the tubulation 14 may be provided with one or more of the balls 28 along with one or more balls 42 carrying an amalgam 44, the amalgam supporting balls 42 typically being of a glass construction.

Figure 11:
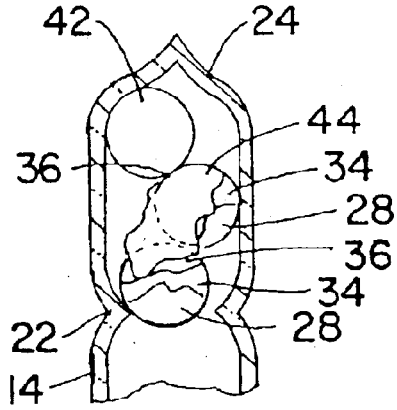
FIG. 11 is similar to FIG. 10, but shows the amalgam in a melted condition.

When the amalgam 44 in the base-up lamp is liquidized, the liquid amalgam tends to flow downwardly and, on occasion flows around the glass balls 42 and into the lamp envelope. However, with the coating 34 in place, the liquid amalgam 44 is attracted to, and adheres to, the coating 34 (FIG. 11) and is thereby prevented from moving further towards the lamp envelope.

Accordingly, the metal balls 28 described hereinabove serve the further function of preventing liquid amalgam from entering the lamp envelope in lamps of the type shown in FIG. 1.

In addition to the advantages of the invention set forth hereinabove, the iron content of the steel bodies 28, 40 has been found to improve results under a Toxicity Characteristic Leaching Procedure (TCLP) prescribed on pages 26981–26998 of volume 55, number 126, of the Jun. 29, 1990 issue of the Federal Register.

Fluorescent lamps contain elemental mercury. During lamp operation, chemical reactions take place that convert some of the elemental mercury to salts or compounds, such as mercuric oxide, that are water soluble. There is a concern that a waste stream resulting from the disposal of fluorescent lamps may leach excessive amounts of the soluble form of mercury. The method of measuring the amount of soluble mercury which may leach from the waste stream resulting from the disposal of fluorescent lamps is described in the TCLP. According to the procedure, the lamp being tested is pulverized into granules having a surface area per gram of material equal to or greater than 3.1 $cm^2$ or having a particle size smaller than 1 cm in its narrowest dimension. Following pulverization, the granules are subjected to a sodium acetate buffer solution having a pH of approximately 4.93 and having a weight twenty times the weight of the granules. The United States Environmental Protection Agency defines a maximum concentration level for mercury at 0.2 milligram leachable mercury per liter leachate fluid when the TCLP is applied. According to the present standards, a fluorescent lamp is considered nonhazardous when less than 0.2 milligram per liter of leachable mercury results using the TCLP.

It has been found to be advantageous, with respect to the TCLP, to provide an effective amount of a chemical agent within the lamp suitable for electrochemically reducing a substantial portion of the soluble mercury to elemental mercury when the lamp is pulverized to granules and subjected to a suitable aqueous acid solution. Preferably, the chemical agent is selected from a group including iron.

The iron in the steel bodies 28, 40 is sufficient to contribute to electrochemically reducing the amount of soluble mercury within the lamp which is leached at the time of disposal to less than 0.2 milligram per liter of the aqueous acid solution prescribed by the TCLP.

The TCLP and the use of iron in the lamp to reduce soluble mercury in the lamp is discussed in U.S. Pat. No. 5,229,687, issued Jul. 20, 1993, in the names of Richard A. Fowler and Robert P. Bonazoli, and is incorporated herein by reference.

Further, it is believed that the metal coating (silver, indium or gold) on the body 28, 40 serves to collect soluble mercury so as to leave little free soluble mercury in a discarded lamp. Such can foreseeably obviate the need for conducting the TCLP, it being necessary only to remove the body 28, 40 and handle disposal of only the body, rather than the entire lamp mass.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A method for introducing a limited amount of mercury into an envelope of a fluorescent lamp during manufacture of the lamp, the method comprising the steps of:

forming the fluorescent lamp with an exhaust tubulation therein, the exhaust tubulation being open at an end thereof;

exhausting the interior of the lamp envelope through the exhaust tubulation open end;

placing a body of metal material not reactive with mercury in the lamp by way of the exhaust tubulation open end, the body having a coating of a metal which amalgams with mercury over a selected surface area of the body, and having mercury on the coated area of the body, such that a limited and selected amount of the mercury is retained on the body by the metal coating; and sealing the open end of the exhaust tubulation;

whereby the amount of mercury retained on the body and thereby introduced into the lamp is limited by the selected surface area of the metal coating on the body.

2. The method in accordance with claim 1 wherein the body is of a selected one of (i) steel and (ii) a steel alloy.

3. The method in accordance with claim 1 wherein the selected surface area comprises a whole of the surface of the body.

4. The method in accordance with claim 1 wherein the selected surface area comprises less than a whole of the surface of the body.

5. The method in accordance with claim 1 wherein the coating is a selected one of silver, gold, indium, copper, tin, and alloys thereof.

6. The method in accordance with claim 1 wherein the amount of mercury retained on the body comprises up to about 9 milligrams.

7. The method in accordance with claim 6 wherein the retained amount of mercury comprises about 2–5 milligrams.

8. The method in accordance with claim 4 wherein the selected surface area comprises a single patch of the surface area.

9. The method in accordance with claim 1 wherein the body comprises a selected one of (i) a ball and (ii) a wire.

10. The method in accordance with claim 9 wherein the body comprises a wire, and including a further step of bending the wire into a U-shaped configuration before placing the wire in the exhaust tubulation.

11. A method for introducing a limited amount of mercury into an envelope of a fluorescent lamp during manufacture of the lamp, the method comprising the steps of:

forming the fluorescent lamp with an exhaust tubulation therein, the exhaust tubulation being open at an end thereof and being provided with a body retention structure proximate the open end;

exhausting the interior of the lamp envelope through the exhaust tubulation open end;

placing a body of metal material not reactive with mercury in the exhaust tubulation between the body retention structure and the exhaust tubulation open end, the body having a coating of a metal which amalgams with mercury, over a selected surface area of the body, and having mercury on the coated area of the body, such that a limited and selected amount of the mercury is retained by the metal coating; and sealing the open end of the exhaust tubulation;

whereby the amount of mercury retained on the body and thereby introduced into the lamp is limited by the selected surface area of the metal coating on the body.

12. The method in accordance with claim 11 wherein the coating is a selected one of silver, gold, indium, copper, tin, and alloys thereof.

13. The method in accordance with claim 11 wherein the body comprises a selected one of (i), a ball and (ii) a wire.

14. A method for introducing a limited amount of mercury into a fluorescent lamp during manufacture of the lamp, the method comprising the steps of:

forming the lamp with an exhaust tubulation therein, the exhaust tubulation being open at an end thereof;

exhausting the interior of the lamp through the exhaust tubulation open end;

providing a body of metal material not reactive with mercury, the body being sized to enter the exhaust tubulation;

electroplating a coating of a selected one of (i) silver, (ii) gold, (iii) indium, (iv) copper, and (v) tin over a selected surface area of the body;

placing mercury on the coated area of the body, such that a limited amount of mercury is retained on the body by the metal coating;

placing the body in the lamp by way of the exhaust tubulation; and sealing the open end of the exhaust tubulation.

15. The method in accordance with claim 14 wherein the body comprises a selected one of (i) a metal sphere and (ii) a metal wire segment.

16. The method in accordance with claim 15 wherein the body comprises a wire segment and the method further comprises the step of forming the wire into a U-shaped configuration.

17. A mercury carrier for placement in a fluorescent lamp during manufacture of the lamp, the carrier comprising:

a body of metal material not reactive with mercury, said body being a wire segment of U-shaped configuration;

a coating of a metal which amalgams with mercury over a selected surface area of said body; and mercury disposed on said metal coating and retained thereby in an amount up to that permitted by the selected surface area of said metal coating;

said body being adapted for retention in the lamp after sealing of the lamp at completion of manufacture, and for introducing the permitted amount of mercury into the lamp.

18. The carrier in accordance with claim 17 wherein said body is a selected one of (i) a sphere and (ii) a wire segment, and is of a selected one of (i) steel and (ii) a steel alloy.

19. The carrier in accordance with claim 18 wherein said coating is a selected one of (i) silver, (ii) gold, (iii) indium, (iv) copper, and (v) tin, and alloys thereof.

20. The carrier in accordance with claim 19 wherein the selected surface of said body comprises a whole of the surface of said body.

21. The carrier in accordance with claim 19 wherein the selected surface of said body comprises less than a whole of the surface of said body.

22. The carrier in accordance with claim 18 wherein the amount of mercury retained by the carrier comprises up to about 9 milligrams.

23. The carrier in accordance with claim 22 wherein the amount of mercury retained by the carrier comprises about 2–5 milligrams.

24. The carrier in accordance with claim 21 wherein the selected surface area of said body comprises a single patch of the surface area.

25. The carrier in accordance with claim 17 wherein said body is adapted for placement in and retention in, an exhaust tubulation disposed in the lamp and sealed at completion of manufacture of the lamp.

26. The carrier in accordance with claim 17 wherein said U-shaped wire segment exhibits sufficient springiness to retain itself in an exhaust tubulation of the lamp.

27. A method for introducing a limited amount of mercury into an envelope of a fluorescent lamp during manufacture of the lamp, and for reducing leachable mercury in the lamp upon destruction of the lamp, the method comprising the steps of:

forming the fluorescent lamp with an exhaust tubulation therein, the exhaust tubulation being open at an end thereof;

exhausting the interior of the lamp envelope through the exhaust tubulation open end;

placing a body of metal comprising iron in the exhaust tubulation open end, the body having a coating of a metal which amalgams with mercury, over a selected surface area of the body, and having mercury on the coated area of the body, such that a limited amount of the mercury is retained by the metal coating; and sealing the open end of the exhaust tubulation;

whereby the amount of mercury retained on the body and thereby introduced into the lamp is limited by the selected surface area of the metal coating on the body; and whereby the iron of the metal body reduces a portion of soluble mercury in the lamp to elemental mercury when the lamp is pulverized.

28. A method for introducing a limited amount of mercury into an envelope of a fluorescent lamp during manufacture of the lamp, and for preventing flow of melted amalgam into the interior of the envelope, the method comprising the steps of:

forming the fluorescent lamp with an exhaust tubulation therein, the exhaust tubulation being open at an end thereof and being provided with a body retention structure proximate the open end;

exhausting the interior of the lamp envelope through the exhaust tubulation open end;

placing a body of metal material not reactive with mercury in the exhaust tubulation between the body retention structure and the exhaust tubulation open end, the body having a coating of a metal which amalgams with mercury over a selected surface area of the body, and having mercury on the coated area of the body, such that a limited and selected amount of the mercury is retained by the metal coating;

placing an amalgam supporting body in the exhaust tubulation between the body of metal material and the tubulation open end; and sealing the open end of the exhaust tubulation;

whereby the amount of mercury retained on the body and thereby introduced into the lamp is limited by the selected surface, area of the metal coating on the body; and whereby the metal coating attracts melted amalgam to prevent the passage of melted amalgam therearound and into the interior of the lamp envelope.

29. The method in accordance with claim 28 wherein the body of metal material is of a selected one of (i) steel and (ii) a steel alloy.

30. The method in accordance with claim 28 wherein the coating is a selected one of silver, gold, indium, copper, tin, and alloys thereof.

* * * * *